US008335133B2

(12) United States Patent
Jouvenot

(10) Patent No.: US 8,335,133 B2
(45) Date of Patent: Dec. 18, 2012

(54) POWER RESERVE DISPLAY MECHANISM

(76) Inventor: Frédéric Jouvenot, La Chaux-de-Fonds (CH)

( * ) Notice: Subject to any disclaimer, the term of this patent is extended or adjusted under 35 U.S.C. 154(b) by 155 days.

(21) Appl. No.: 13/013,978

(22) Filed: Jan. 26, 2011

(65) Prior Publication Data

US 2011/0182152 A1 Jul. 28, 2011

(30) Foreign Application Priority Data

Jan. 27, 2010 (CH) ..... 0099/10

(51) Int. Cl.
*G04B 9/00* (2006.01)

(52) U.S. Cl. ..... 368/66; 368/210

(58) Field of Classification Search ..... 368/66, 368/210, 212
See application file for complete search history.

(56) References Cited

U.S. PATENT DOCUMENTS

| | | | | |
|---|---|---|---|---|
| 5,699,322 | A * | 12/1997 | Born | 368/66 |
| 5,790,478 | A * | 8/1998 | Besson | 368/66 |
| 7,170,825 | B2 * | 1/2007 | Takahashi | 368/66 |
| 7,357,568 | B2 * | 4/2008 | Gerber et al. | 368/212 |
| 7,614,784 | B2 * | 11/2009 | Watanabe | 368/210 |
| 7,857,502 | B2 * | 12/2010 | Rochat | 368/212 |
| 2009/0129211 | A1 | 5/2009 | Rochat | |
| 2010/0278018 | A1 | 11/2010 | Jouvenot | |

FOREIGN PATENT DOCUMENTS

| | | | |
|---|---|---|---|
| CH | 101851 | A | 11/1923 |
| CH | 162786 | A | 7/1933 |
| CH | 300362 | A | 7/1954 |
| CH | 301497 | A | 9/1954 |
| CH | 696561 | A5 | 7/2007 |
| EP | 1826633 | A1 | 8/2007 |
| WO | 2009056498 | A1 | 5/2009 |

OTHER PUBLICATIONS

Swiss Search Report, dated Oct. 29, 2010, from corresponding Swiss application.

* cited by examiner

*Primary Examiner* — Sean Kayes
(74) *Attorney, Agent, or Firm* — Young & Thompson

(57) ABSTRACT

A power reserve display mechanism includes a differential (22) having:

a first input (22*a*) connected to a ratchet (16) of a barrel (24) and to an oscillating mass automatic winding system, a second input (22*b*) connected to the drum of a barrel (24), an output (22*c*) connected to a display system. The display system includes at least one disc (40) provided with digits for displaying numbers between a minimum number and a maximum number. Moreover, the disc is connected to the output (22*c*) of the differential (22) via a reduction train (26), arranged such that the display system displays the minimum number when the barrel is empty and the maximum number when the barrel is maximally loaded. The reduction train and the automatic winding system are arranged such that the disc advances by one pitch each time the oscillating mass performs on revolution.

13 Claims, 5 Drawing Sheets

POWER RESERVE DISPLAY MECHANISM

TECHNICAL FIELD

The invention relates to the horology field. It more particularly relates to a power reserve display mechanism including a differential comprising:

a first input connected to the ratchet of a barrel and to an oscillating mass automatic winding system, a second input connected to the drum of the barrel, an output connected to a display system.

BACKGROUND OF THE INVENTION

The power reserve display of a watch is a very widespread complication. This information is generally displayed by a hand moving opposite a graduation whereof the two ends represent the maximum and minimum load, respectively, of the barrel(s) powering the movement. The hand is mounted on a wheel whereof the speed of rotation is arranged so that it travels across the entire graduation in a period of time equal to the power reserve.

The present invention aims to propose a new power reserve display system that not only is original, but that also provides increased precision when reading the power reserve.

BRIEF DESCRIPTION OF THE INVENTION

More precisely, the invention relates to a power reserve display mechanism as mentioned in the first paragraph above, wherein the display system comprises at least one disc provided with digits to display numbers included between a minimum number and a maximum number. Moreover, the disc is connected to the output of the differential by a reduction train, arranged so that said display system displays the minimum number when the barrel is empty and the maximum number when the barrel is fully loaded.

The reduction train and the automatic winding system are arranged such that the disc advances by one pitch each time the oscillating mass performs one revolution.

The display mechanism can then serve as a revolution counter for the oscillating mass, in particular in the case where the automatic winding system is bidirectional.

BRIEF DESCRIPTION OF THE DRAWINGS

Other details of the invention will appear more clearly upon reading the following description, done in reference to the appended drawing, in which.

DETAILED DESCRIPTION OF THE INVENTION

Figure 1:
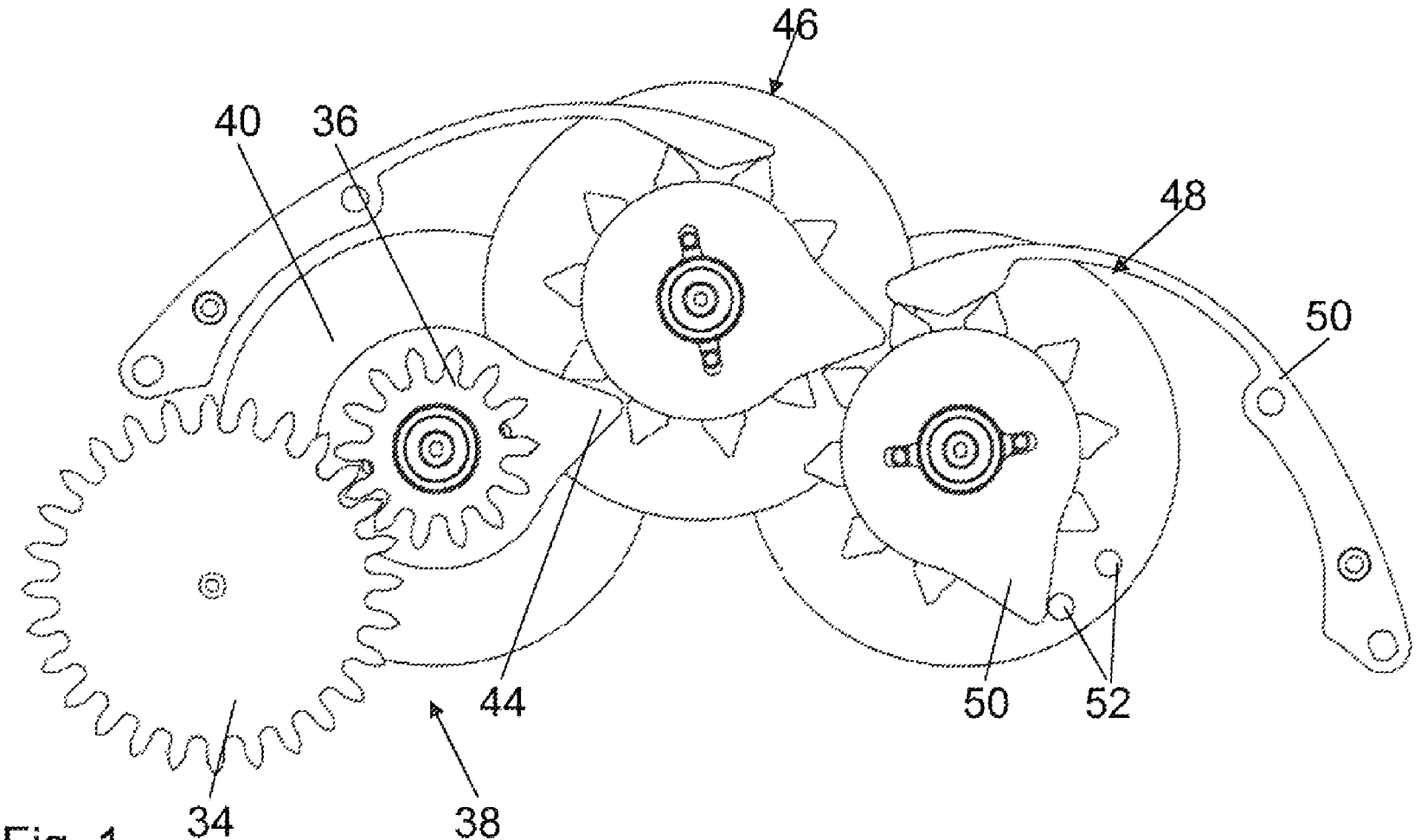
FIG. 1 is a top view of the mechanism according to the invention.
Figure 2:
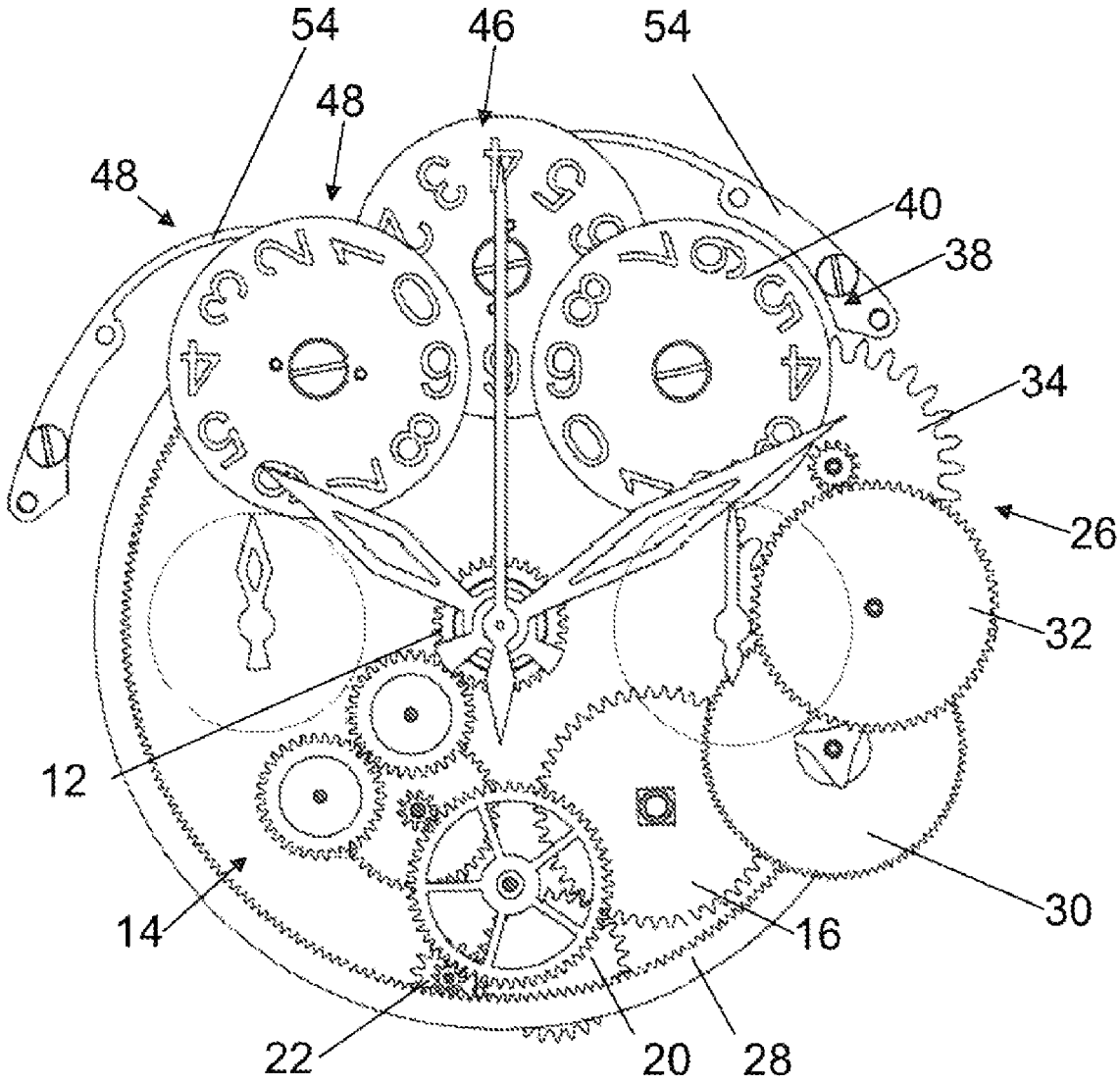
FIG. 2 is a cross-sectional view of part of the mechanism, in particular of the reduction train and the display system.
Figure 3:
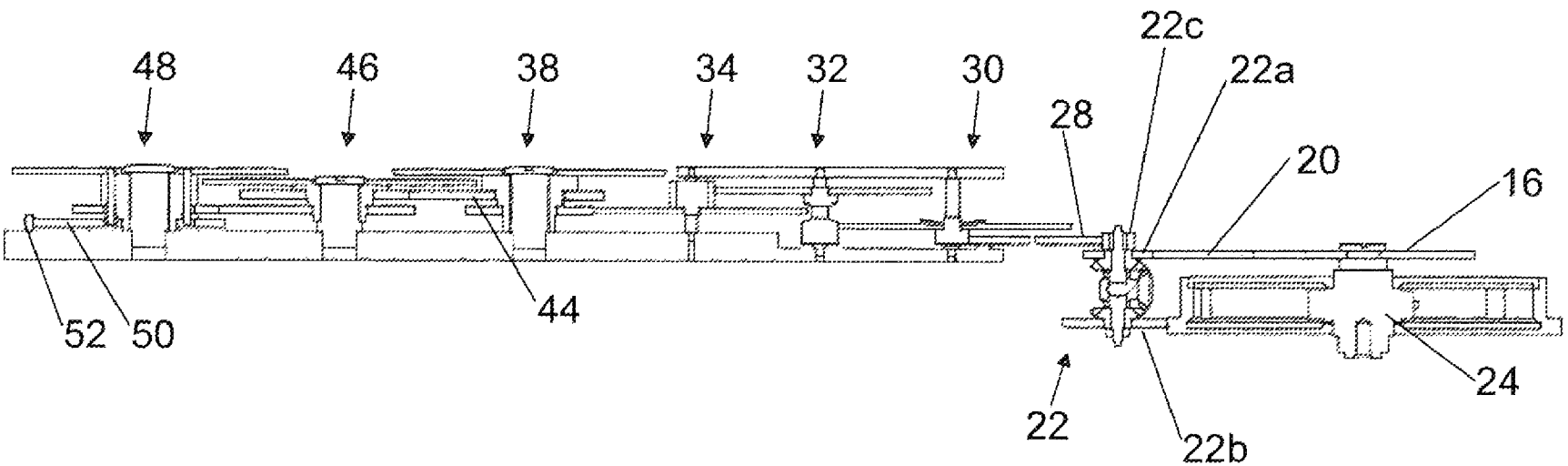
FIG. 3 is a bottom view of the display system.
Figure 4:
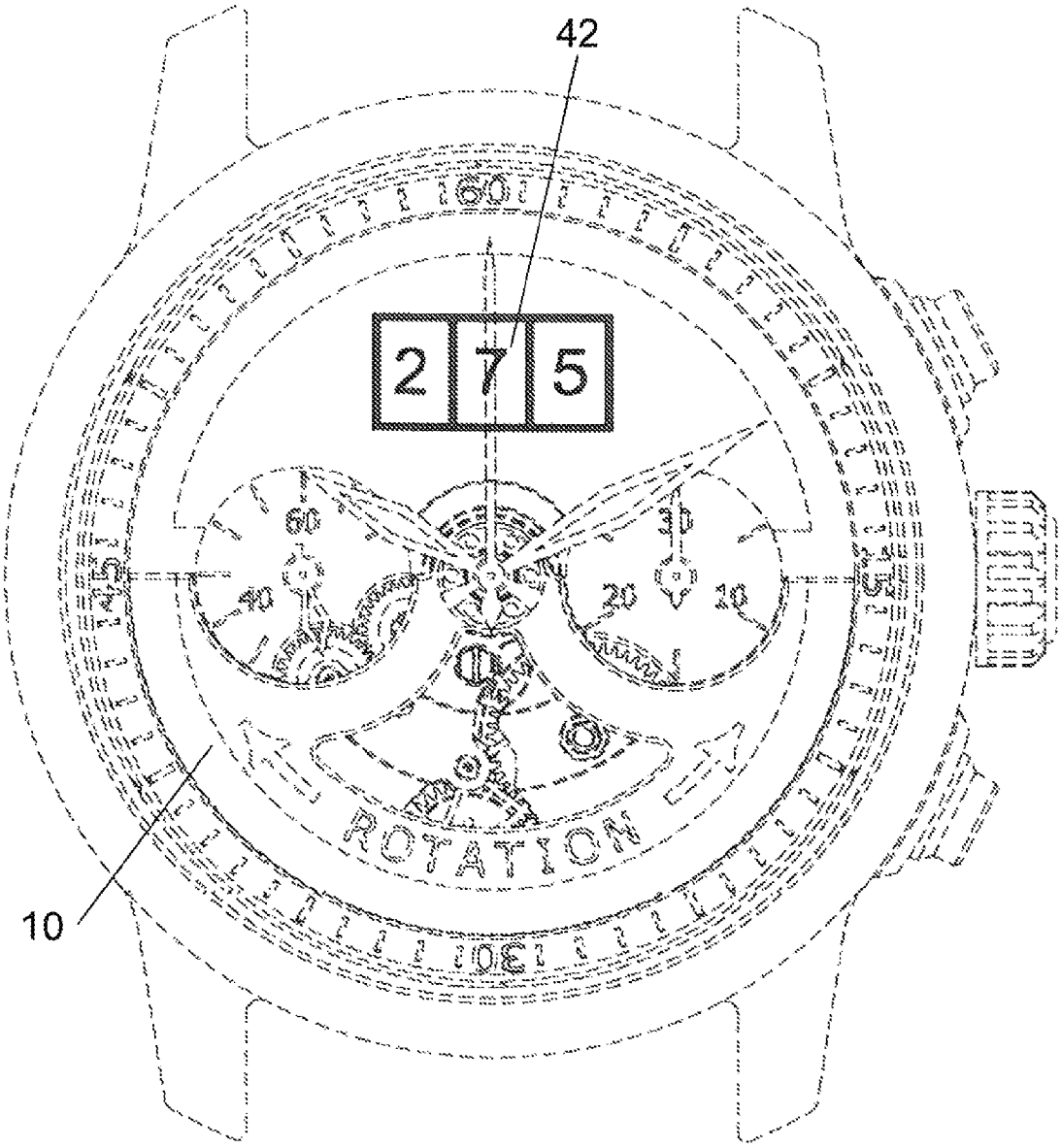
FIGS. 4 and 5 illustrate two examples of timepieces provided with a mechanism according to the invention.

The mechanism illustrated in FIG. 1 includes an automatic winding system, the force of which is taken from the motion of an oscillating mass 10, not shown, but visible in FIG. 4, pivoting freely under the effect of gravity and the wearer's movements. In the proposed example, the mass 10 is pivoted at the center of the movement and drives a pinion 12. Conventionally, this pinion 12 meshes with a gear train 14, including a reverser system, in order always to drive a ratchet 16 of a barrel 24 in the same direction. Because those skilled in the art know automatic winding systems perfectly, it is not necessary to describe it in detail. Any type of bidirectional system can be used in the context of the invention.

According to the proposed example, the last wheel of the gear train 14, which we will call ratchet winding wheel 20, is engaged with a first input 22*a* of a differential 22. This differential 22 can be of the conical type, as generally used in power reserve mechanisms. Thus, conventionally, the differential 22 also comprises a second input 22*b* connected to the drum of the barrel 24, in order to thus differentiate between the received energy and that provided by the barrel 24. The output 22*c* of the differential 22 is connected to a display system that we will described in detail hereinafter.

The display system is connected to the output 22*c* of the differential 22 by a reduction gear 26. In one advantageous embodiment at the space occupied by the mechanism, the reduction train 26 comprises a carrier ring 28, provided with an inner toothing engaged with the output 22*c* of the differential 22 and positioned at the periphery of the movement, concentric thereto. Such a ring 28 makes it possible to kinematically connect two wheels spaced apart, without inserting a large number of intermediate wheels between them. This ring 28 drives the pinion of a friction wheel 30, the role of which will emerge later. Its function makes it possible to disengage the kinematic connection in the reduction train 26 to which it belongs, when a certain torque is reached.

The friction wheel 30 also includes a wheel that drives a first reduction gear 32, itself driving a second reduction gear 34. The wheel of this second wheel assembly is engaged with a pinion 36 of a first display train 38.

More particularly, this first display train 36 includes a disc 40, mounted integral with and coaxial to the pinion 36. This disc 40 is provided, on its face positioned on the side intended to be displayed, with digits 0 to 9 regularly distributed on the periphery thereof. The digits are intended to appear in a window 42 formed in the dial. The first display train 38 can also include a driving finger 44, intended to drive, once per revolution, a second display train 46. The latter part is similar to the first and is arranged to drive a third display train 48. Although, in this example, the third train 48 is not intended to drive a fourth, it nevertheless includes a finger 50, intended to cooperate with two stop pins 52 forming bankings, in order to limit the driving of the third train 48. The three trains are positioned such that the digit of each disc is adjacent to the others, to display, as will be understood below, a number in the windows 42. In other words, the three windows are side by side, or extend each other and form a single large window.

Specific to the proposed embodiment, it will be noted that the pinion 36 of the first display train 38 is provided with a toothing permanently engaged with the second reduction train 34, which causes a dragging movement. The second 46 and third 48 display trains are driven in a jumping manner by the interaction between the finger of the preceding train and their toothing, with which a jumper 54 cooperates ensuring their positioning and part of their driving. The shape of the teeth of the second 46 and third 48 trains, relative to the jumpers and the fingers, is determined so as to obtain good bidirectional cooperation, without shock or blocking between the various elements. Thus, the teeth can be in the shape of isosceles triangles and are each separated by a free space. Naturally, the pinions of the display trains driven in a jumping manner include ten teeth. It is also possible to consider having a first display train driven in a jumping manner by placing a finger on the second reduction train 34 and adding a jumper cooperating with the pinion 36. In this case, it will also have ten teeth. It is also possible to consider that all discs are driven in a dragging manner.

The arrangement of the display trains therefore makes it possible to display, in base 10 and a coordinated manner, the numbers 000 to 999, the first, second and third display trains respectively corresponding to the ones, tens, and hundreds of the displayed number, i.e. to powers 0, 1 and 2 of base 10, respectively. It is therefore the train intended to display the value with the largest power that cooperates with the pins 52.

According to the invention, the automatic winding system and the reduction train 26 are arranged such that the display system displays the number of revolutions performed by the mass. In the proposed example, the disc 40 of the first display train 38 is incremented by one unit upon each revolution performed by the mass. A revolution means a rotation of 360°, such a 360° rotation can be performed by fractions, eventually separated by fractions performed in both directions, angular displacements performed in both directions being added.

In parallel, in one advantageous embodiment, the automatic winding system and the barrel 24 are calculated such that the total load of the barrel 24, i.e. from 0 to 100%, is achieved in a number of revolutions of the oscillating mass corresponding to the maximum display capacity of the display system, i.e. the largest number capable of being displayed by the discs.

The display obtained is thus both an original display of the power reserve of the barrel 24 and a revolution counter of the oscillating mass.

Thus, during operation, the differential 22 makes it possible to drive the ring 28 by differentiating between the energy conveyed to the barrel 24 (via the automatic winding system or by a manual winding system) and the energy taken by the movement. Depending on whether the difference is positive or negative, the display system increments or decrements the displayed figure between 000 and 999. At these two extreme values, the finger of the third display train 48 abuts against the stop pins 52. At the maximum value, if the barrel 24 is still loaded, its slip-spring will produce its effect, but, if applicable, the stop pin makes it possible to keep the display in the correct position. The friction train 30 then plays its role to avoid any breakage or blocking in the train, by disengaging the kinematic connection between the ring 28 and the first reduction train 32. This advantageously makes it possible to rematch the display with the state of the barrel 24, in the event a deviation occurs for any reason. Likewise, at the minimum value, if a deviation exists between the displayed value and the actual power reserve, the display stays at 000 and the friction performs its function to rematch the display and the power reserve.

Figure 5:
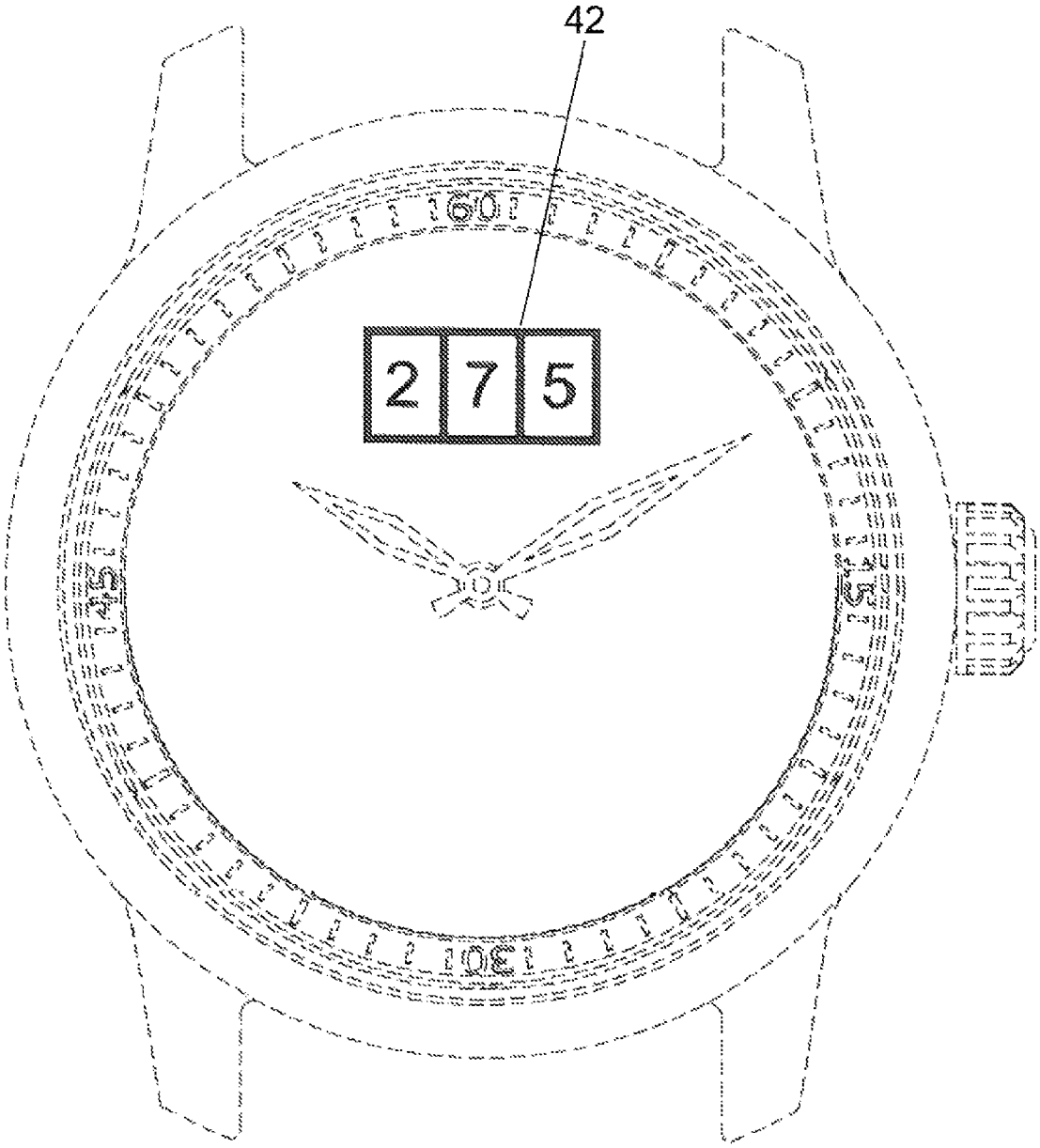

A mechanism is thus proposed offering an oscillating mass revolution counter and a power reserve display that is particularly original and precise to the $1/999^{th}$. FIGS. 4 and 5 in particular show examples of the implementation of such a display, as well as the visual output obtained. It is thus compatible with an arrangement of the mass on the bottom side or dial side, as taught in application WO09056498 in the applicant's name.

Such a mechanism can also be directly adapted for a watch only having manual winding, the power reserve thus being displayed digitally. It is then possible to eliminate the automatic train. In this case, for a maximum power reserve R, and a display able to display a minimum number n and a maximum number N, the reduction train 26 can be arranged to increment the display of a unit every R/(N−n). Alternatively, if a power reserve display mechanism according to the invention is adapted to an existing caliber, without specific calculation of the reduction train, the maximum number displayed N can be different from the maximum display capacity. Thus, in practice, a display able to display 999 will only display, when the power reserve is at its maximum, any value whatsoever, below 999. This maximum value being able to be determined, the power reserve display is no less precise and functional.

Moreover, this mechanism can also be adapted with a single-direction automatic train system, i.e. in which the rotation of the mass only winds the barrel 24 in a single direction of rotation. In this case, the power reserve display remains, but the revolution counting for the oscillating mass becomes more relative. Indeed, only the rotations done in one direction are counted. The counter displays the number of revolutions performed only in one direction.

Moreover, various alternatives can be provided relative to the display without going beyond the scope of the invention. Naturally, the number of revolutions proposed in the example is not limiting, the display can be incremented by one pitch every two revolutions . . . or a digital display can even be done using a single disc.

What is claimed is:

1. A power reserve display mechanism including a differential comprising:

a first input connected to the ratchet of the barrel and to an oscillating mass automatic winding system, a second input connected to the drum of a barrel, an output connected to a display system, said display system comprising at least one disc provided with digits for displaying numbers between a minimum number and a maximum number, said disc being connected to the output (22*c*) of the differential (22) via a reduction train (26), arranged such that said display system displays the minimum number when the barrel is empty and the maximum number when the barrel is maximally loaded, wherein said reduction train and the automatic winding system are arranged such that said disc advances by one pitch each time the oscillating mass performs one revolution.

2. The display mechanism of claim 1, wherein the display system comprises several discs kinematically connected to each other so as to display the power reserve digitally in base 10.

3. The display mechanism of claim 2, wherein the disc that is intended to display the value with the largest power is arranged to evolve between first and second extreme positions, said extreme positions being defined by bankings.

4. The display mechanism of claim 1, wherein the display system comprises several discs kinematically connected to each other so as to display, in base 10, the number of revolutions performed by the mass.

5. The display mechanism of claim 4, wherein the automatic winding system is arranged such that the maximum power reserve of the barrel is reached in a number of oscillating mass revolutions corresponding to the maximum display capacity of the display system.

6. The display mechanism of claim 5, wherein the disc that is intended to display the value with the largest power is arranged to evolve between first and second extreme positions, said extreme positions being defined by bankings.

7. The display mechanism of claim 4, wherein the disc that is intended to display the value with the largest power is arranged to evolve between first and second extreme positions, said extreme positions being defined by bankings.

8. The display mechanism according to claim 1, wherein the reduction train comprises a friction train provided with a wheel and a pinion frictionally connected.

9. The display mechanism according to claim 1, wherein said at least one disc of the display system is driven in a jumping manner by a finger positioned at the end of the reduction train.

10. The display mechanism according to claim 1, wherein the winding system is bidirectional.

11. The display mechanism of claim 10, wherein one revolution is counted each time the oscillating mass rotates of 360°, angular displacements performed in both directions being added.

12. The display mechanism of claim 10, wherein one revolution is counted each time the oscillating mass rotates of 360°, angular displacements performed in a single direction being added.

13. The display mechanism according to claim 1, wherein the winding system is a single-direction automatic train system.

* * * * *